United States Patent [19]

Scheurecker et al.

[11] 4,146,083

[45] Mar. 27, 1979

[54] ARCUATE SUPPORTING AND GUIDING CONSTRUCTION FOR CONTINUOUSLY CAST STRANDS

[75] Inventors: Werner Scheurecker, Linz; Franz Hoppel, Vienna; Alois Scheinecker, Linz, all of Austria

[73] Assignee: Vereinigte Österreichische Eisen- und Stahlwerke-Alpine Montan Aktiengesellschaft, Linz, Austria

[21] Appl. No.: 730,783

[22] Filed: Oct. 8, 1976

[30] Foreign Application Priority Data

Oct. 16, 1975 [AT] Austria ..... 7885/75

[51] Int. Cl.[2] ..... B22D 11/00

[52] U.S. Cl. ..... 164/448; 193/35 R

[58] Field of Search ..... 164/82, 282, 448; 193/35 R; 226/89

[56] References Cited

U.S. PATENT DOCUMENTS

| | | | |
|---|---|---|---|
| 3,710,847 | 1/1973 | Schoffmann | 164/282 |
| 3,757,848 | 9/1973 | Scholz et al. | 164/282 |
| 3,812,900 | 5/1974 | Bollig et al. | 164/282 X |
| 3,946,798 | 3/1976 | Uchimoto et al. | 164/282 |
| 4,007,822 | 2/1977 | Scheurecker | 164/282 X |
| 4,046,188 | 9/1977 | Kagerhuber et al. | 164/448 |

FOREIGN PATENT DOCUMENTS

| | | | |
|---|---|---|---|
| 1508859 | 8/1966 | Fed. Rep. of Germany | 164/282 |
| 1286699 | 1/1969 | Fed. Rep. of Germany | 164/282 |
| 2143146 | 3/1973 | Fed. Rep. of Germany | 164/282 |
| 2536038 | 2/1976 | Fed. Rep. of Germany | 164/282 |

*Primary Examiner*—Richard B. Lazarus

*Attorney, Agent, or Firm*—Brumbaugh, Graves, Donohue & Raymond

[57] ABSTRACT

An arcuate supporting and guiding construction for continuously cast strands, in particular slabs, has a framework comprised of at least two framework parts, sets of inner and outer arcuate longitudinal carriers positioned within the framework and accommodating rollers to form roller paths supporting the strand at two opposite sides thereof, and a plurality of spaced drawing anchors arranged at right angles to the roller paths to connect the oppositely arranged framework parts, wherein the drawing anchors can be brought into and out of a connection position and detached and removed from one of the framework parts.

13 Claims, 6 Drawing Figures

ARCUATE SUPPORTING AND GUIDING CONSTRUCTION FOR CONTINUOUSLY CAST STRANDS

BACKGROUND OF THE INVENTION

The invention relates to a supporting and guiding arc for continuously cast strands, in particular for continuously cast slabs, having roller paths supporting the strand at opposite sides. The rollers of the roller paths are journaled in arcuate longitudinal carriers arranged in a framework and suitably the arcuate longitudinal carriers of one or both roller path(s) are adjustable or braceable relative to the framework under elastic deformation for adjustment to various strand thicknesses.

By means of such a supporting and guiding arc, as it is described in Austrian Pat. No. 290,750 (U.S. Pat. No. 3,710,847), e.g., the strand is deflected from an approximately vertical into an approximately horizontal direction. The rollers lie precisely on predetermined curved paths without discontinuities, even after a re-adjustment of the roller path distance, so that no unpermissible and locally limited forces can act on the strand skin. The arcuate longitudinal carriers designed in one piece are essential for this construction, and these arcuate longitudinal carriers extend over the entire arcuate range of the supporting and guiding arc. In this known supporting and guiding arc, repair and maintenance work proves disadvantageous, in particular when rollers have to be exchanged or new arcuate longitudinal carriers have to be inserted. In order to do this it is necessary to take the faulty roller path, together with the rollers mounted thereon, out of the framework in longitudinal direction of the roller paths, after the arcuate longitudinal carriers of that roller path have been detached from the rigid framework. The great length, the arcuate shape and the weight of the roller path to be removed in its entirety present great difficulties, since, depending on the direction of removal, sufficient space is necessary above or following the guiding arc and since crane equipment is necessary which has to be operated very carefully to assure a faultless removal and insertion of the roller paths without damaging them. It is a further disadvantage that the complicated removal requires a lot of time. In particular, when only a few rollers have to be exchanged, the ratio between the costs and amount of work caused by the removal and installation of the complete arcuate longitudinal carriers relative to the maintenance and repair work to be carried out is particularly unfavorable.

SUMMARY OF THE INVENTION

The invention aims at preventing these disadvantages and difficulties and has as its object to create a supporting and guiding arc of the above-defined kind, whose roller paths can be made accessible easily and quickly and whose rollers can be removed without removal of the arcuate longitudinal carriers. It is a special object not to have to take the arcuate longitudinal carriers out of the framework in the longitudinal direction of the roller path when removing them, but to be able to remove them in a space-saving manner from the framework, while maintaining the advantageous construction of the one piece arcuate longitudinal carriers.

According to the invention, this object is achieved in that the framework comprises at least two parts carrying the roller paths and that opposite framework parts are connected by a number of drawing anchors arranged at a distance from one another and at right angles relative to the roller paths, the drawing anchors being detachable from a connecting position on one of the framework parts and removable therefrom.

Suitably, the framework is divided parallel to the roller paths, into an arc-outer and arc-inner framework part carrying the arc-outer and arc-inner roller path.

For easy operation of the drawing anchors, the drawing anchors in the arc-outer framework part are displaceably journaled in their longitudinal direction and are retractable from the connection position by adjustment means, such as pressure medium cylinders, into the arc-outer framework part.

According to a preferred embodiment, the framework parts are connectable with one another by wedges that can be driven into a longitudinal slot of the drawing anchors. The wedge allocated to the arc-inner framework part is capable of being brought into and out of engagement with the drawing anchor by an adjustment means, such as a pressure medium cylinder, and the drawing anchor is displaceable with it longitudinal slot along the wedge that is allocated to the arc-outer framework part and is rigidly connected thereto. Thus it is possible to detach all the wedges simultaneously by remote control or to bring them into engagement with the drawing anchors, respectively, whereby the separation or the assembly, respectively, of the framework parts can be carried out within the shortest time possible.

Advantageously, for easier adaptation and for avoiding the necessity of using a separate crane therefor, the arc-outer framework part is journaled in a fixed bearing and in an expansion bearing on the base, and is liftable and lowerable by lifting means arranged in these bearings.

Suitably, the arc-inner framework part is hinged with play to a carrying stand by means of brackets.

For a particularly easy removal of the arc-inner framework part, the latter is hinged to a carrying stand by means of lifting elements, such as pressure medium cylinders, which carrying stand is supported on the base.

If the roller parts are to be especially conveniently accessible, it is advantageous that after a separation of the framework parts the outer framework part or the complete, unseparated guiding arc is depositable on a horizontally movable car by means of lifting elements.

BRIEF DESCRIPTION OF THE DRAWINGS

The invention shall now be described by way of example only and with reference to the accompanying drawings, wherein.

DESCRIPTION OF EXEMPLARY EMBODIMENTS

Figure 1:
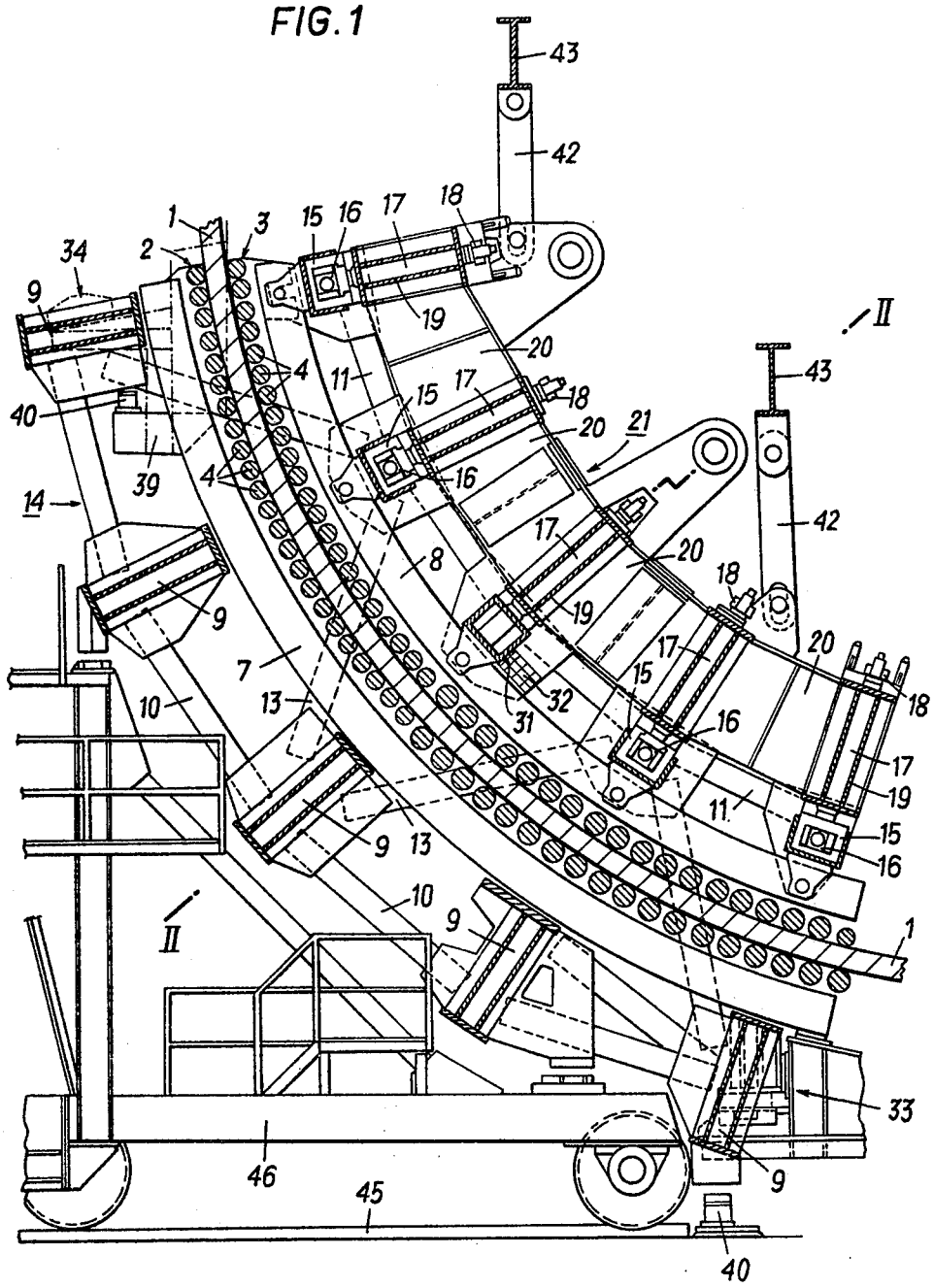
FIG. 1 is a vertical section through the supporting and guiding arc in the longitudinal direction of the roller paths.

A cast strand 1 is supported and guided between roller paths 2 and 3. Rollers 4 of the two roller paths 2 and 3 are inserted in bearing supports 6 by means of their bearings 5, which bearing supports are secured to arcuate longitudinal carriers 7 and 8. In order to avoid a too pronounced sagging of the long and relatively thin rollers 4, the latter are supported via arcuate longitudinal carriers at about each third of their length. The arcuate longitudinal carriers 7 carrying the arc-outer roller path 2 are secured to transverse carriers 9 by screws not shown in detail. The transverse carriers 9 are connected to an arcuate framework part 14 by props 10, 11, 12 and 13 arranged at both sides of the roller path.

Figure 2:
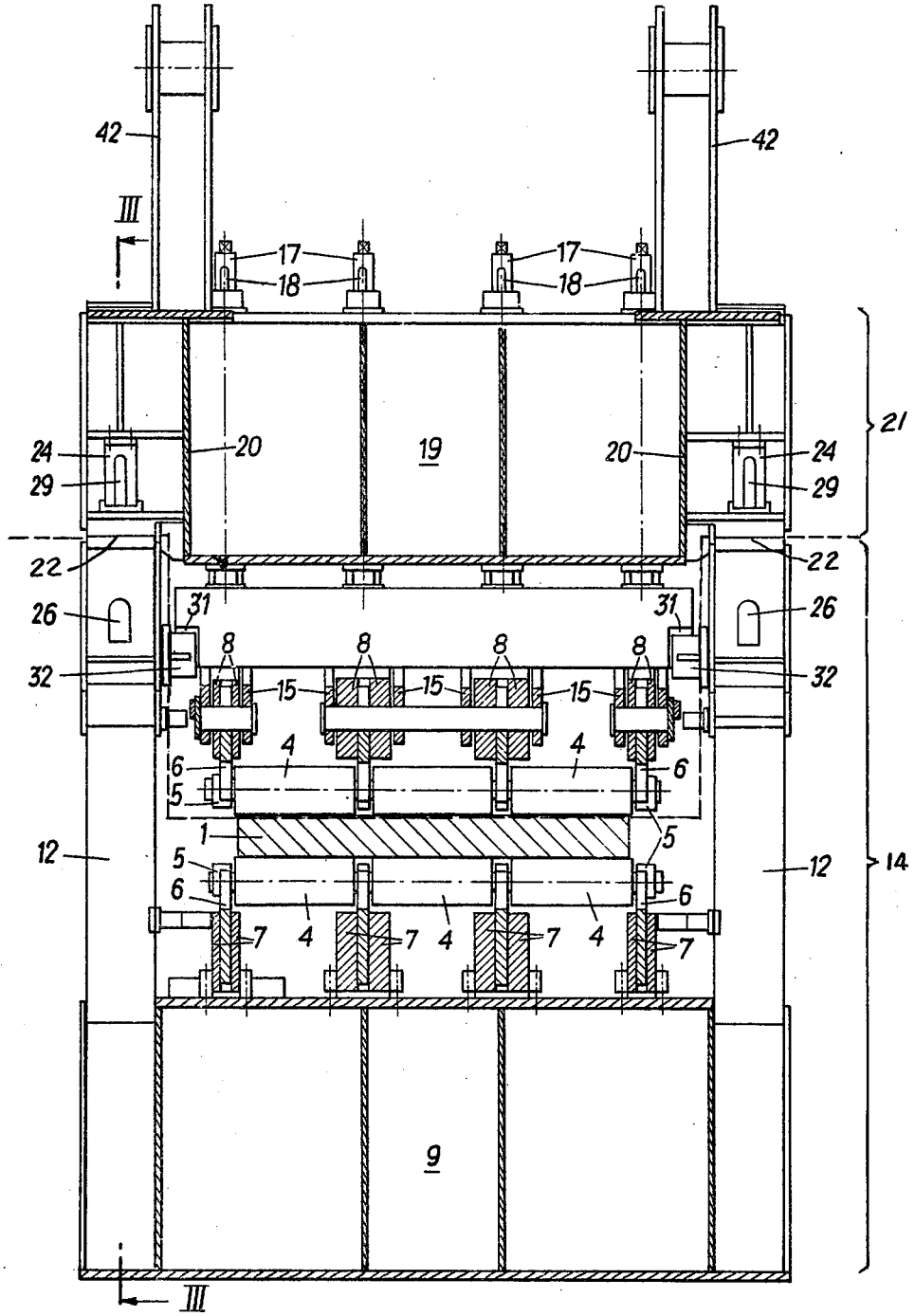
FIGS. 2 and 3 are sections along lines II—II and III—III of FIGS. 1 and 2, respectively.
Figure 3:
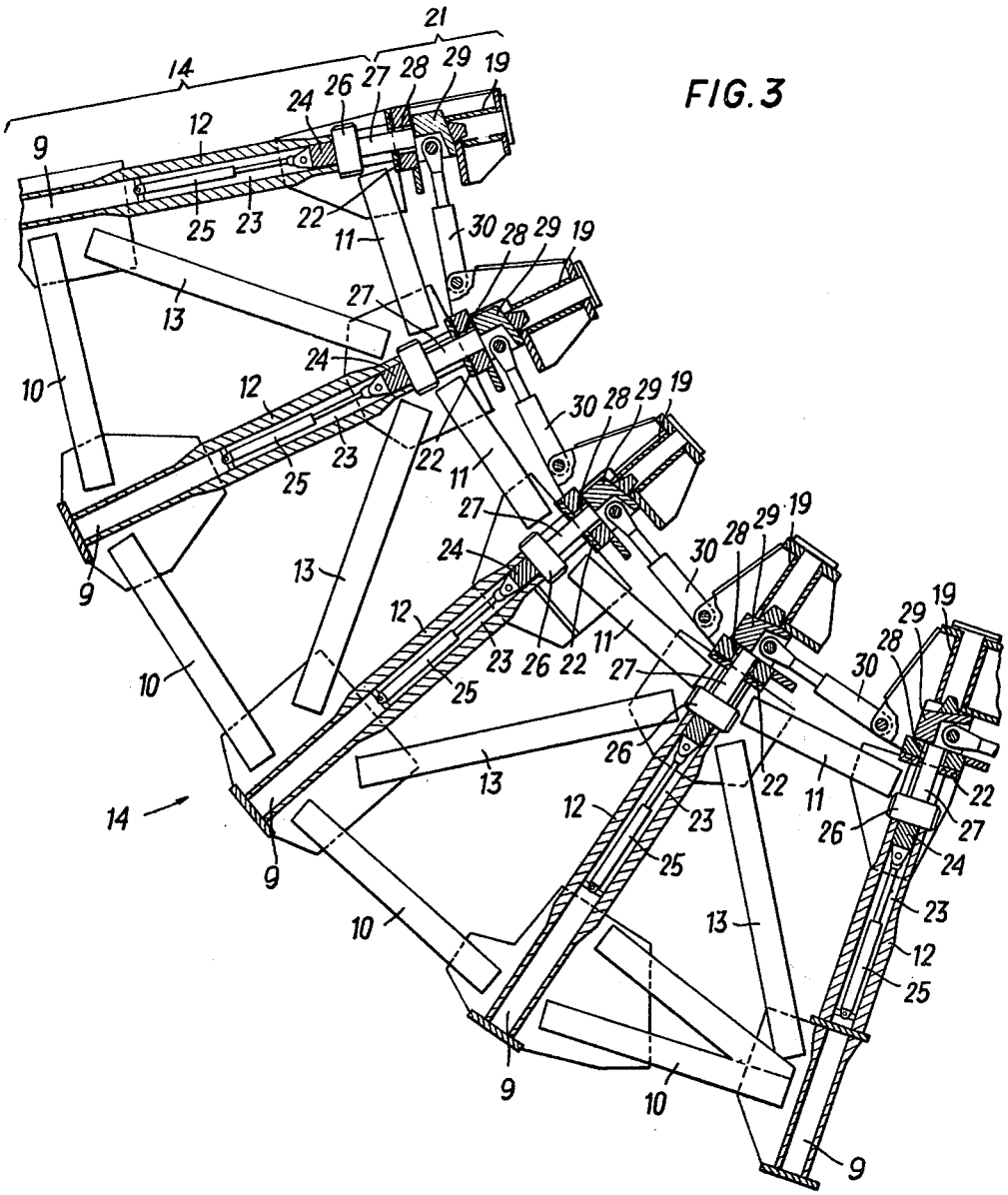

The arcuate longitudinal carriers 8 carrying the arc-inner roller path 3 are provided with a number of eyes 15 with slots, wherein sliding blocks 16 are displaceably arranged. The sliding blocks 16 are detachably connected by bolts 17 and by wedge connections 18 with transverse carriers 19, which among themselves are combined to a further arcuate framework part 21 by web plates 20. In the operating position, this arc-inner framework part 21 with its transverse carriers 19 rests on the flange-like ends 22 of the props 12 of the framework part 14 arranged at a right angle to the roller paths. In FIG. 2 a dashed line shows the dividing line between the two framework parts and the roller paths attached to each, surface 22 being the contacting face for the two parts. The hollow space 23 provided in the props 12 and extending in the longitudinal direction thereof, serves for accommodating drawing anchors 24 and pressure medium cylinders 25 hinged thereto. By means of these cylinders the drawing anchors 24 can be completely retracted into the hollow space 23 of the props 12 from a position, in which they protrude over the ends of the props 12 as shown in FIG. 3. Each drawing anchor 24 has a longitudinal slot 27 penetrated by a wedge 26 pushed hard into each prop 12. These wedges 26 serve for guiding and limiting the path of movement of each drawing anchor.

The framework part 21 is provided with bores 28 in the transverse carriers 19. The drawing anchors penetrate the bores 28 with play when the framework parts are in the assembled condition. For fixing the framework parts on each other, there are provided wedges 29 which are insertable into the longitudinal slots 27 of the drawing anchors 24 and slide in bronze guides. The wedges 29 can be actuated by a quick and simultaneous actuation of pressure medium cylinders 30. For an easier alignment of the two framework parts during their assembly, consoles 32 are provided on the middle ones of the props 12, the framework part 21 being capable of being brought to a stop by the consoles abuting its counterfaces 31 corresponding to these consoles. Thus an alignment of the bores 28 with the drawing anchors 24 is obtained in a simple and safe manner.

Figure 4:
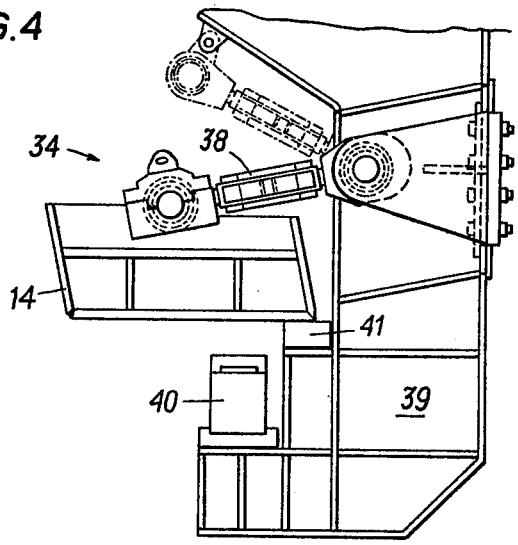
FIG. 4 is a view of the expansion bearing.
Figure 5:
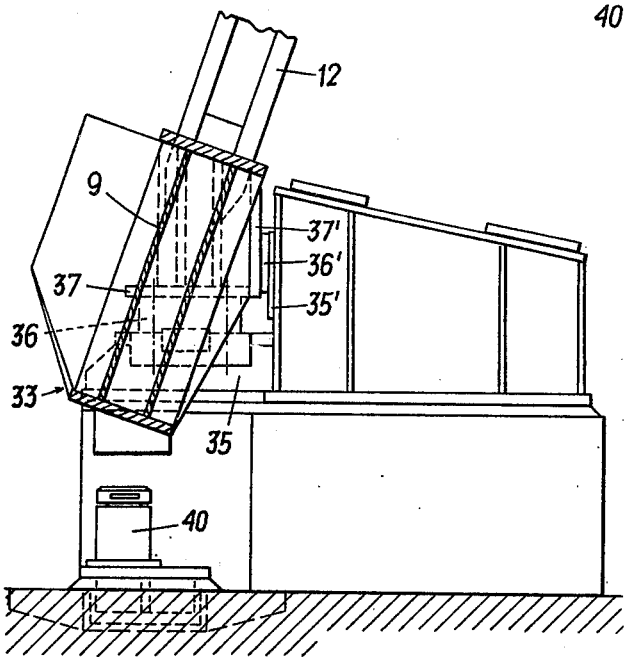
FIG. 5 is a view of the fixed bearing of the arc-outer framework part.

The arc-outer framework part 14 is arranged on the base by fixed bearings 33 provided at both sides of the framework part at the lower end thereof and by expansion bearings 34 provided at both sides at the upper end, as illustrated in detail in FIGS. 4 and 5. Each fixed bearing 33 substantially comprises a supporting plate 35 horizontally arranged on the base and a supporting plate 35' vertically arranged on the base , the lowermost, last transverse carrier being supported thereon with corresponding counterfaces 37 and 37' via shims 36 and 36'. The supporting face 37 of each fixed bearing is secured relative to the base by screws not illustrated in detail. The expansion bearings 34 are designed as bracket bearings with the bracket 38, whose length is adjustable and which is detachable from the framework part 14 for removal of the latter, being hinged to the framework part 14 itself as well as to the stand part 39 rigidly connected to the base. Length changes of the framework 14 during operation thus can be accommodated. After detaching the brackets 38, shims 41 serve for downwardly supporting the framework part 14. All of the bearings are provided with lifting means 40, by which the framework part 14 can be lifted and lowered.

Figure 6:
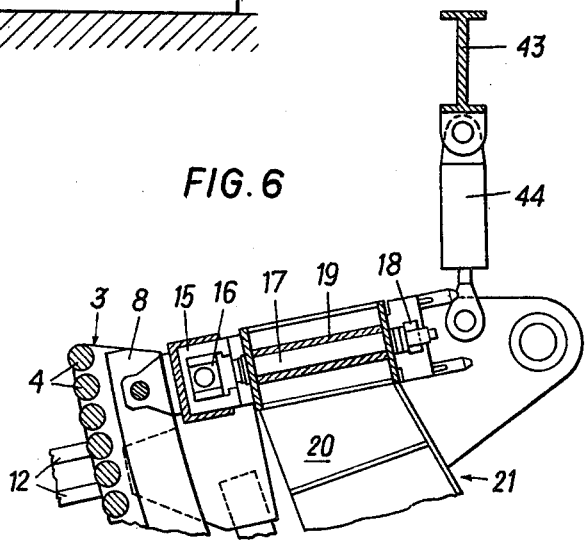
FIG. 6 is a detail of the suspension of the arc-inner framework part.

The arc-inner framework part 21 (FIG. 1) is hinged to a base-supported carrying stand 43 by brackets 42 in such a manner that in the operating position, i.e. when the two framework parts 14 and 21 rest upon each other, play is present between the brackets 42 and the framework part 21 and the brackets are not loaded by the weight of the arc-inner framework part 21. Instead of the brackets, advantageously pressure medium cylinders 44 can also serve for the suspension of the framework part 21, as illustrated in FIG. 6, whereby the arc-inner framework part 21 becomes liftable and lowerable and thus is easier to lift from the arc-outer framework part to create an enlargement of the roller gap.

A car 46 movable on rails 45 serves for moving out the arc-outer framework part 14 or the whole casting arc.

In separating the framework parts the wedges 29 first have to be detached from the drawing anchors 24 with the help of the pressure medium cylinders 30, whereupon the drawing anchors are retracted into the hollow space 23 of the props 12 by means of the pressure medium cylinders 25. When the shim 41 has been positioned underneath the expansion bearing, the brackets 38 are detached from the framework part 14, the two framework parts are lifted by the lifting means 40, the shims 36, 36' and 41 are removed, and both framework parts are lowered again. During the lowering, the arc-inner framework part 21 is stayed by the brackets 42 and thus remains suspended on the carrying stand 43. After a further lowering, the arc-outer framework part 14 is deposited on the car 46 and can then be moved to a repair stand, e.g.. If pressure medium cylinders 44 are provided instead of the brackets 42, only the arc-inner framework part 21 has to be lifted by the pressure medium cylinders 44 after the drawing anchors have been detached and retracted for carrying out repair work. This has the advantage that the arc-outer framework part need not be lifted off the base.

For minor repair work on the plant, the gap present between the roller paths 2 and 3 can also be widened in the following manner: After detaching and retracting of the drawing anchors 24 into the hollow spaces 23 of the props 12, the wedges 29 are again brought into the position in which they would engage with the drawing anchors, if drawing anchors were present. Thereupon the arc-inner framework part 21 can be lifted, according to the desired enlargement of the gap, via the wedges 29 by telescoping the drawing anchors 24 out of the hollow spaces of the props 12 until the play with which the drawing anchors fit into the bores 28 of the transverse carriers 19 is used up.

An excessive loading of the rollers of the two roller paths, as may occur when an already cooled strand is conveyed, can be quickly and effectively avoided with the supporting and guiding arc of the invention, in that the wedges 29 are retracted from the drawing anchors 24, whereby the framework part 21 can immediately detach itself from the framework part 14.

The invention shall not be limited to the illustration of the Figures, but may be modified in various respects. In large plants it may be advantageous to use two or more framework parts divided transversely to their longitudinal extension and detachably connected to each other instead of using roller-path-carrying framework parts which are uninterrupted in longitudinal extension.

What we claim is:

1. In an arcuate supporting and guiding construction for continuously cast strands, in particular slabs, of the type including a framework, a set of inner arcuate longitudinal carriers and a set of outer arcuate longitudinal carriers positioned within the framework, and a plurality of rollers connected to each of the sets of longitudinal carriers to form roller paths supporting the strand on two opposite sides thereof, the improvement comprising:

at least two oppositely arranged framework parts carrying one roller path each, one of the at least two framework parts being arranged to rest on the other along contacting faces when they are in an operating position;

a plurality of drawing anchors holding the contacting faces in abutment when in a connection position and being arranged at right angles to the arcuate roller paths so as to attach the oppositely arranged framework parts together when the framework parts are in the operating position, the drawing anchors being distributed over the longitudinal extension of the arcuate longitudinal carriers at a distance from one another;

anchor adjustment means for extending said drawing anchors into the connection position and retracting them from said connection position;

connecting means for connecting said drawing anchors to the at least two framework parts, said connection means being arranged so that the drawing anchors are detachable from at least one of said framework parts so that they can be brought out of the connection position by said adjustment means; and means for moving one of said framework parts with respect to the other when the drawing anchors are retracted from the connection position, whereby the framework parts are removed from the operating position and no longer rest on each other.

2. An arcuate supporting and guiding construction as set forth in claim 1, wherein at least one of the sets of longitudinal carriers is elastically deformable and braceable relative to the framework for adjustment to various strand thicknesses.

3. An arcuate supporting and guiding construction as set forth in claim 1, wherein the framework is divided parallel to the roller paths into a roller-path-carrying arc-outer framework part and a roller-path-carrying arc-inner framework part.

4. An arcuate supporting and guiding construction as set forth in claim 3, wherein the drawing anchors are arranged on the arc-outer framework part so as to be displaceable in their longitudinal direction, and the anchor adjusting means are arranged for retracting said drawing anchors from their connection position into the arc-outer framework part.

5. An arcuate supporting and guiding construction as set forth in claim 4, wherein the adjusting means are pressure medium cylinders.

6. An arcuate supporting and guiding construction as set forth in claim 3, wherein said drawing anchors each include a longitudinal slot and said connecting means comprises:

wedges allocated to the arc-inner and arc-outer framework parts, the wedges allocated to the arc-inner framework part being adapted to be pushed into each drawing anchor longitudinal slot in order to connect the framework parts, the wedges allocated to the arc-outer framework part being rigidly connected thereto and each drawing anchor being displaceable with its pertaining longitudinal slot along the pertaining rigidly connected wedge by means of said anchor adjustment means, and wedge adjustment means for bringing the wedges allocated to the arc-inner framework part into and out of engagement with the slots of the pertaining drawing anchor.

7. An arcuate supporting and guiding construction as set forth in claim 6, wherein the wedge adjustment means for bringing the wedges allocated to the arc-inner framework part into and out of engagement with the pertaining drawing anchor are pressure medium cylinders.

8. An arcuate supporting and guiding construction as set forth in claim 3, further comprising a fixed bearing and an expansion bearing to support the arc-outer framework part and lifting means provided in said fixed bearing and said expansion bearing for lifting and lowering said arc-outer framework part.

9. An arcuate supporting and guiding construction as set forth in claim 3, further comprising a carrying structure and brackets for hinging the arc-inner framework part to the carrying structure with play.

10. An arcuate supporting and guiding construction as set forth in claim 3, further comprising a carrying structure and lifting elements hinging the arc-inner framework part to the carrying structure.

11. An arcuate supporting and guiding construction as set forth in claim 10, wherein said lifting elements are pressure medium cylinders.

12. An arcuate supporting and guiding construction as set forth in claim 3, further comprising a horizontally displaceable car and lifting elements for depositing the arc-outer framework part, after separation from the arc-inner framework part, on the horizontally displaceable car.

13. An arcuate supporting and guiding construction as set forth in claim 3, further comprising a horizontally displaceable car and lifting means for depositing the complete, unseparated arcuate supporting and guiding construction on the horizontally displaceable car.

* * * * *